US007112923B2

(12) United States Patent
Kingston et al.

(10) Patent No.: US 7,112,923 B2
(45) Date of Patent: Sep. 26, 2006

(54) LAMP ASSEMBLY WITH A RETAINER CONNECTING A STEM TO A LAMP CAPSULE

(75) Inventors: Richard A. Kingston, Beverly, MA (US); Brian G. Lariviere, Hampstead, NH (US); Peter A. Marcaurelle, Peabody, MA (US)

(73) Assignee: Osram Sylvania Inc., Danvers, MA (US)

( * ) Notice: Subject to any disclaimer, the term of this patent is extended or adjusted under 35 U.S.C. 154(b) by 340 days.

(21) Appl. No.: 10/651,132

(22) Filed: Aug. 28, 2003

(65) Prior Publication Data

US 2005/0046354 A1 Mar. 3, 2005

(51) Int. Cl.
*H01J 17/18* (2006.01)
*H01J 1/02* (2006.01)

(52) U.S. Cl. ..... 313/625; 313/25; 313/11; 313/17

(58) Field of Classification Search ..... 313/242, 313/623, 624, 625, 285, 287, 290, 318.03, 313/318.05, 318.07, 318.01, 49, 11, 17, 25; 439/168

See application file for complete search history.

(56) References Cited

U.S. PATENT DOCUMENTS

| | | | | |
|---|---|---|---|---|
| 4,361,782 | A | 11/1982 | Reiling | 315/73 |
| 5,023,505 | A | 6/1991 | Ratliff et al. | 313/25 |
| 6,188,164 | B1 * | 2/2001 | Brown et al. | 313/25 |
| 6,720,718 | B1 * | 4/2004 | Trent et al. | 313/332 |

* cited by examiner

*Primary Examiner*—Mariceli Santiago
*Assistant Examiner*—Anne M Hines
(74) *Attorney, Agent, or Firm*—Carlo S. Bessone

(57) ABSTRACT

A stem and lamp capsule are connected together as an assembly using a retainer such that the stem is clamped to one end of the retainer and the capsule is clamped to the other end of the retainer. An oxidizable fuse is connected between leads of the capsule and electrical conductors of the stem. The retainer maintains the rigidity of the assembly and keeps a constant distance between the stem and the lamp capsule so that the repeatability and failure parameters of the fuse length can be maintained within acceptable tolerance.

30 Claims, 11 Drawing Sheets

LAMP ASSEMBLY WITH A RETAINER CONNECTING A STEM TO A LAMP CAPSULE

BACKGROUND OF THE INVENTION

The present invention relates to a retainer connecting a fused stem and a lamp capsule in a lamp assembly.

Currently, various techniques are being used or are being investigated for manufacturing Halogen type lamps. A first method incorporates a double-ended halogen capsule into a non-standard incandescent envelope. This method has a disadvantage in being restricted to a non-standard envelope and can not be used in "conventional" lighting envelopes known to those of ordinary skill in the art. However, the non-standard envelope is costly. In addition, the outer glass envelope is subject to breakage, which may present a fire hazard as the wall temperature of the capsule is high enough to ignite various materials, such as paper and fabric.

Another known capsule uses a relatively thick, heavy glass walled envelope to minimize possible breakage. Such a heavy glass walled envelope is also non-standard and expensive to manufacture. In addition, the heavy glass walled envelope reduces the transmission of light and while the heavy glass walled envelope reduces the risk of breakage, when breakage does occur, the fire hazard is still present and a user is still subject to burns caused by exposure to the hot capsule.

A number of designs have been offered to interrupt electrical current to an inner lamp and reduce or effectively eliminate the fire hazard in the event of damage to an outer lamp envelope. A method known for use with a high intensity discharge lamp involves positioning an oxidizable fuse within the outer envelope of the lamp and in series with the lamp circuit. Such a fuse oxidizes and interrupts the lamp circuit, in the event the outer envelope breaks and exposes the fuse to air, thereby extinguishing the lamp and reducing the risk of fire.

One of the concerns in manufacturing such lamps is providing a satisfactory manner in which to support the lamp capsule and fuse within the outer envelope. It is known to fabricate such lamps by electrically and mechanically connecting the fuse directly to electrical conductors within the outer envelope by welding and the like. This may involve a complicated fabrication procedure, and in some instances it may be difficult to accurately maintain the repeatability and failure parameters of the fuse. When using a coiled fuse, for example, the pitch of the coil determines the repeatability and failure parameters of the fuse. Specifically, the length of the fuse defined as from the start of the coiled part of the fuse to the end of the coiled part of the fuse should be maintained at a constant length (±0.05 mm). In addition, the lamp capsule must be adequately supported within the outer envelope. Such supports may be complicated and may typically include straps, which surround the capsule at opposite ends thereof and are attached to One or more support rods extending from an inlead protruding from the lamp stem.

An example of a high intensity discharge lamp, which includes an oxidizable fuse within the outer envelope, is described in U.S. Pat. No. 4,361,782. In this patent, the inner lamp capsule is supported within an outer lamp envelope by strap clips welded to a rod, which is welded to an inlead extending from the lamp stem, the rod extending to a looped clip which engages an anchoring dimple of the outer envelope. The oxidizable fuse is part of the lamp circuit being connected to an inlead and a main electrode. However, the rod to which the fuse is connected is subject to bending. Such bending would bring the fuse outside the above-noted acceptable length tolerance.

A further improvement is shown in U.S. Pat. No. 5,023,505 to Ratliff et al. in which FIGS. 1 to 3 depict an electric lamp 2 in a hermetically sealed outer glass envelope 4. A pair of electrical conductors 8 and 10 is sealed into and passes through the stem 12 of the outer glass envelope in a conventional manner. An arc tube 14 having a pair of spaced electrodes 16 and 18 is electrically connected to a respective electrical conductor in a conventional manner to provide an electrical circuit.

A support member 22 supports arc tube 14 and is electrically isolated from the electrical circuit and is within the outer glass envelope 4. The support member 22 is held in place relative to the stem 12 at one end of the support member by a stem clip 24. The support member can alternatively be welded on the outer surface of the stem clip. As seen in FIG. 2, the support member includes two elongated legs 38 and 40, which are preferably welded to the stem clip 24.

As further seen in FIG. 2, the support member 22 also supports a conventional heat shield 42 by first strap member 44 and second strap member 46. The first and second strap members 44 and 46 are welded to legs 38 and 40 so as to extend therebetween in a direction normal to the longitudinal axis 36.

As depicted in FIG. 3, each elongated leg 38 and 40 is disposed between an inner surface 52 of the stem clip 24 and outer surface 54 of an inert material 50 so that the stem clip 24 forms a sleeve. The sleeve-like stem clip 24 includes a first end 56 and an opposite second end 58. In assembling the stem clip 24, inert material 50 is wrapped around the stem 12, and the stem clip 24 is firmly wrapped around stem 12 with the sleeve-like inert material 50 interposed between the inner surface 52 of the stem clip and the outer surface of the stem 12. Upon completion of the wrapping of the stem clip 24, the ends 56 and 58 are welded together at 60.

As depicted in FIGS. 1 and 2, an oxidizable fuse 48 may be included outside of the arc tube 14 and within the outer envelope 4. Fuse 48 interrupts the lamp current in the event the outer envelope is fractured in order to prevent possible exposure to ultraviolet light.

However, the design of Ratliff et al. has a number of problems. First, the support member of FIGS. 1 to 3 requires various welds to connect the legs 38, 40 to the stem clip 24 and to straps 44, 46. The legs require support at the stem clip 24, the straps 44, 46 and the top of the support near 48. Accordingly, the support shown in FIGS. 1–3 is still fairly complicated and unwieldy. Second, the fuse 48 is relatively long and subject to damage during manufacturing. Specifically, the fuse may contact legs 38, 40 during insertion into the envelope 4 causing the fuse to break or causing the fuse to short. Further since the legs 38, 40 are spindly, the support member 22 is subject to bending or twisting which would place stresses on the fuse causing the fuse to break and render the lamp inoperable. In addition, since the fuse 48 may be a coiled construct, such bending would affect the length of the coiled section and bring the fuse outside acceptable tolerances.

In attempts to overcome the problems of the conventional electric lamp and simplify the support, other lamps have been offered. Another conventional electric lamp such as that taught by U.S. 2003/0057834 to Kling and shown in FIGS. 4 and 5 illustrate a support 100 assembled with a lamp 101. Support 100 includes a first portion 102 mechanically connectable to a lamp capsule 103. A conductive second portion 104 of the support 100 is electrically and mechanically connectable to a first lead wire 105, as for example, by welding. The support 100 also includes a conductive third portion 106 electrically and mechanically connected to a first electrical conductor 107. A fuse 109 is electrically and mechanically connected between the second portion 104 and the third portion 106. A second electrical conductor 111 is electrically connected to a second lead wire 113. In FIGS. 4 and 5, the fuse 109 is connected to the second portion 104 and third portion 106 by clamps 108 and 110, respectively.

The support 100 for the fuse is attached to lamp capsule 103, such that the first portion 102 of the support is mechanically connected to the lamp capsule 103. Walls 114 and 116 of the lamp capsule 103, including flanges 120 and 122, are structured and arranged to slidingly mate with rail 124 or rail 132 of the lamp capsule 103. Rail 124 is dimensioned to be force fit into the opening 126 between the walls 114 and 116 of the support 100, the walls 114, 116 bearing against respective rail surfaces to hold the lamp capsule 103 in place relative to the support 100. The lamp capsule 103 may have one or more locking segments that engage respective mating locking segments of the support walls to hold the capsule in place relative to the support.

The second portion 104 of the support 100 comprises a first segment 142 extending from the third portion 106, and a second segment 144 extending from the first segment 142. The lead wire 105 is electrically and mechanically connected to the second segment 144, as for example, by welding the lead wire to surface 146.

The support of KLING also has various problems. Specifically, there are automation difficulties because the heavy leads require non-standard glass forming techniques and can be prone to press failures in the lead entry area. Additionally, the step of separating the clip "bridge" from the fuse clamp creates problems in maintaining the tolerance requirements of the fuse length. Specifically, maintaining the centerline distance between clamps 108, 110 is critical. When the "bridge" is separated, stored energy is released in the relevant parts. Accordingly, when a segment of the retainer (106' in FIG. 5) is removed by the cutting process, the release of stored energy allows movement of the retainer changing the centerline distance and subsequently leading to loss of tolerance in the fuse length.

SUMMARY OF THE INVENTION

It is an object of the present invention to provide an improved retainer for a lamp capsule and a stem assembly positioned within an outer envelope.

A further object of the present invention is to provide an economical, efficient and high quality retainer for a lamp capsule and stem assembly device positioned within an outer envelope.

Another object of the present invention is to provide an electric lamp which includes the retainer of the present invention.

A yet further object of the present invention is to provide an improved method of coupling a lamp capsule to a lamp stem.

Still another object of the present invention is to provide a less costly manner of supporting a lamp capsule and a stem assembly in place within an outer lamp envelope.

Yet a further object of the present invention is to provide support for a lamp capsule and stem assembly, within an outer lamp envelope, that simplifies manufacturing, reduces component count and ensures accurate control of fuse length.

This invention achieves these and other objects by providing a novel retainer, for a lamp capsule and a stem assembly. The retainer includes first and second rigid frames having first and second ends. The retainer joins the lamp capsule to the stem assembly such that the stem is clamped between respective first ends and the lamp capsule is clamped between respective second ends. A pyrophoric fuse is electrically connected in series with lead wires of the stem and capsule. The frame has an opening therethrough in which the lead wires, and the fuse are exposed. A lamp including the retainer of the present invention, and a method of coupling a lamp capsule to a stem assembly, are also provided.

BRIEF DESCRIPTION OF THE DRAWINGS

Other objects and characteristics of the invention will become more apparent from the description given in further detail below with reference to the accompanying drawings in which.

DETAILED DESCRIPTION OF THE PREFERRED EMBODIMENTS

In an automated process, repeatability is important to ensure a consistent high quality product. In the lamp art, problems have arisen in manufacturing a lamp assembly having an oxidizable fuse such that it is difficult to maintain the repeatability and failure parameters of the fuse length within acceptable tolerance. The inventors of the present invention have found that a rigid, generally rectangular frame, is easiest to manufacture and offers the best solution to prevent movement of the capsule with respect to the stem so that the fuse length can be maintained within acceptable tolerances. Preventing movement of the stem with respect to the capsule allows the tolerance requirements of the fuse to be very tight so that a manufacturing tolerance of ±0.05 mm for the fuse length can be maintained.

Figure 1:
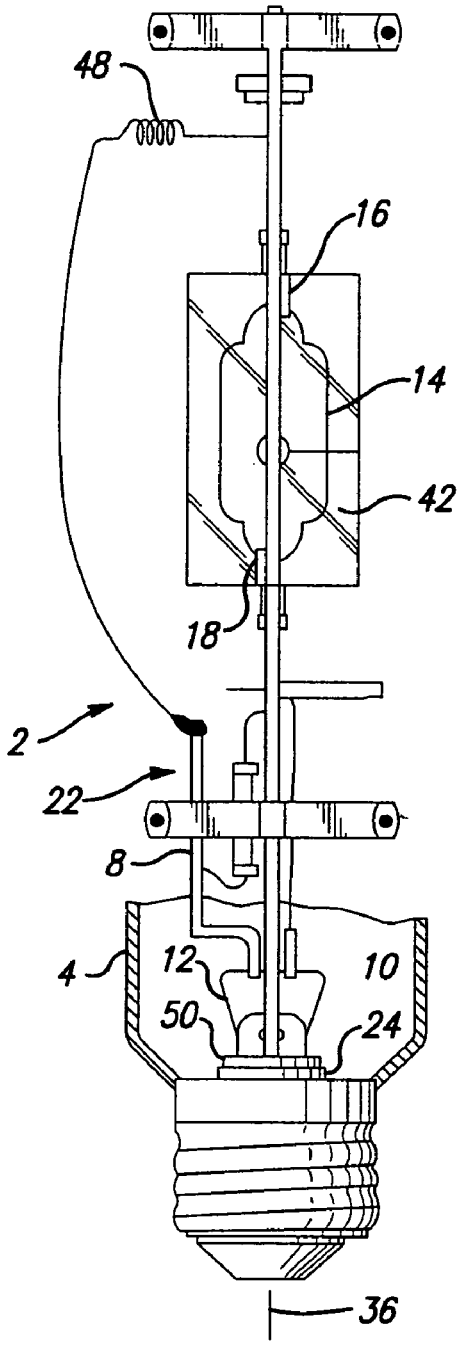
FIG. 1 PRIOR ART
FIG. 1 is a partial cross-sectional view of a conventional electric lamp.
Figure 2:
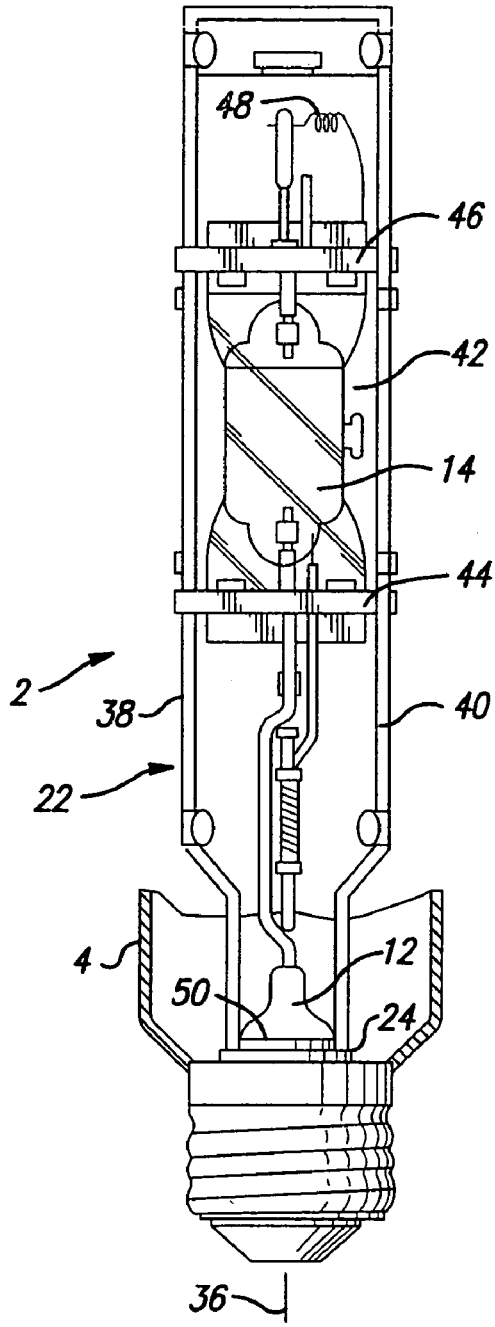
FIG. 2 PRIOR ART
FIG. 2 is a partial cross-sectional view of the lamp of FIG. 1 rotated 90° about its longitudinal axis.
Figure 3:
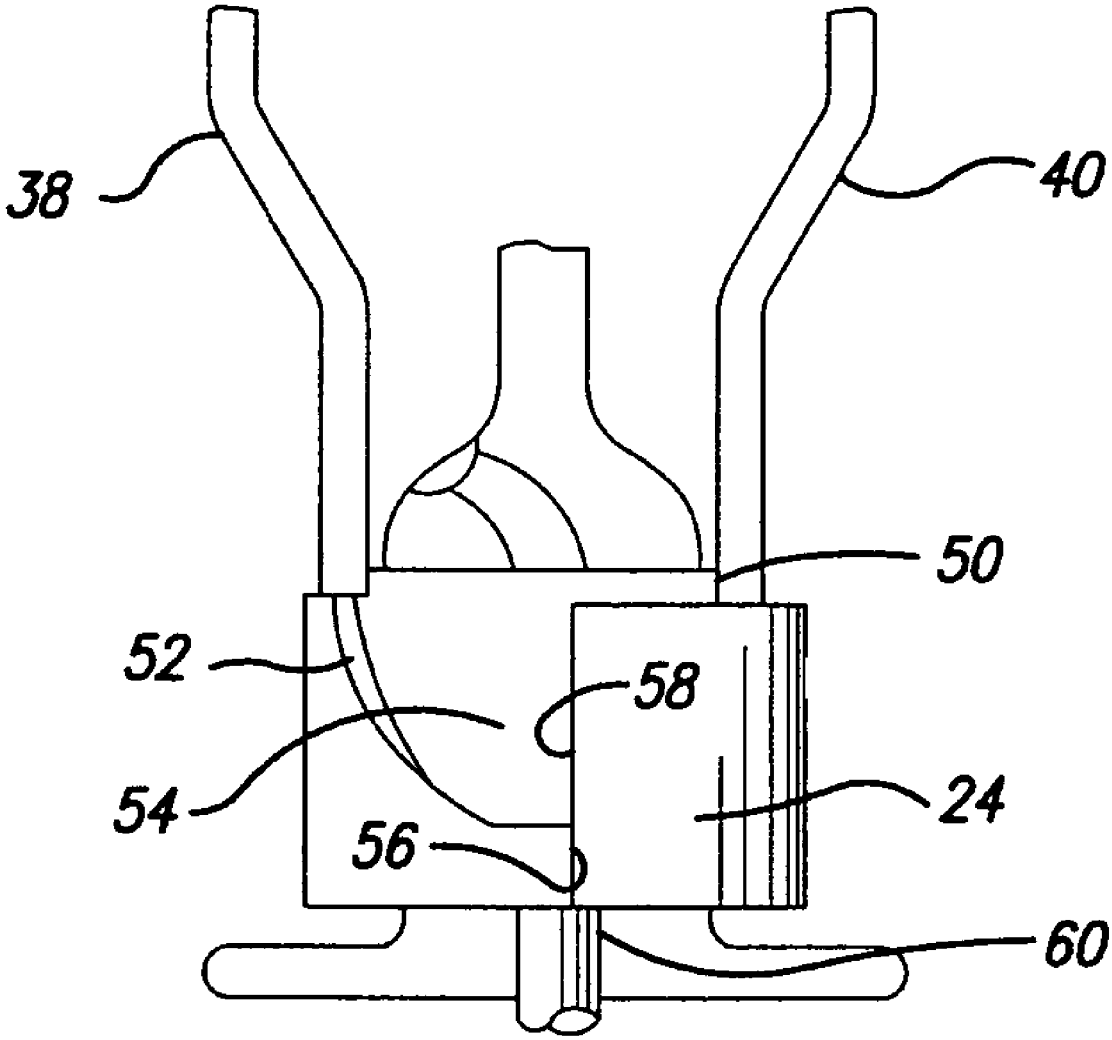
FIG. 3 PRIOR ART
FIG. 3 is an enlarged view of the stem clip arrangement of FIG. 2.
Figure 4:
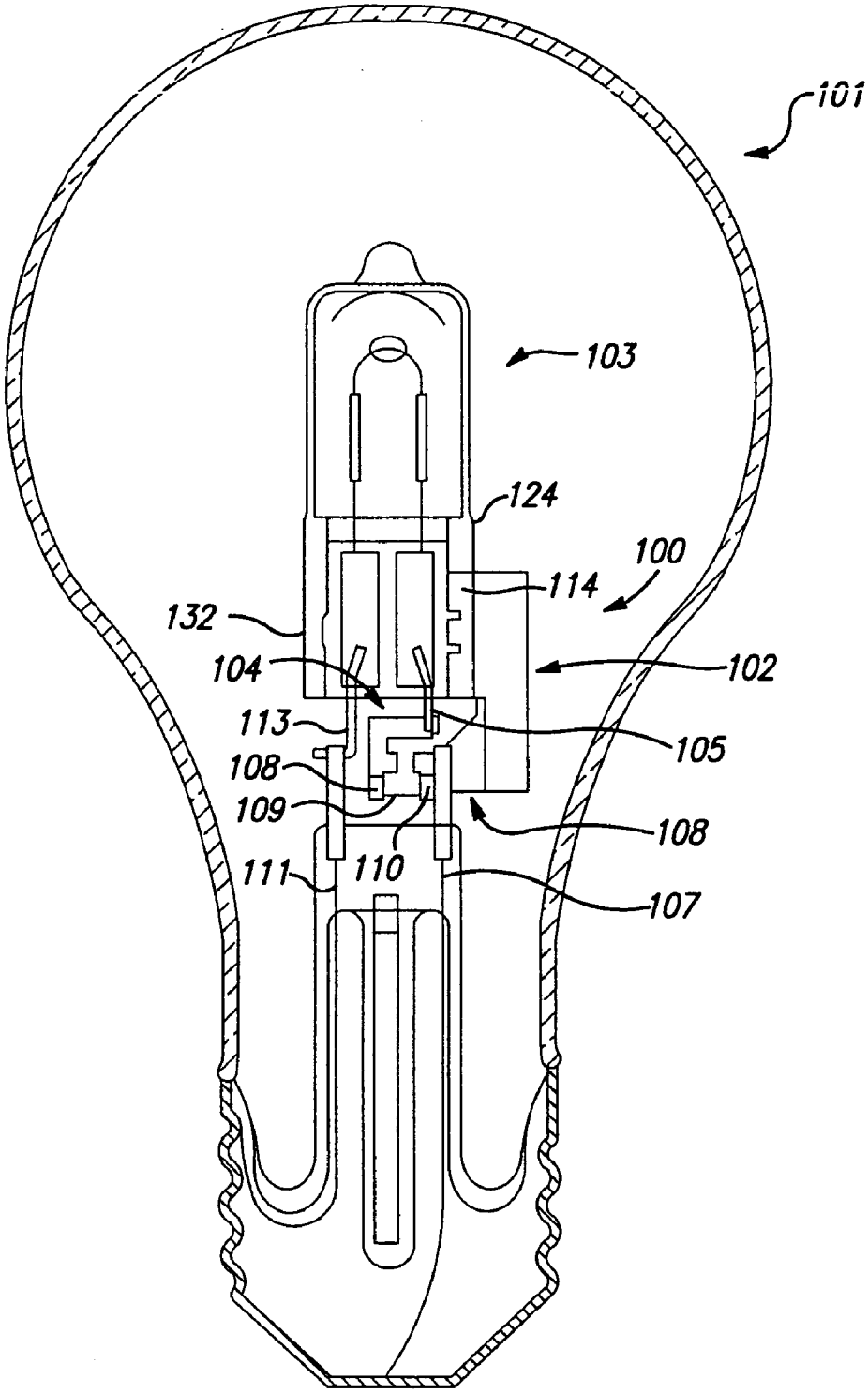
FIG. 4 PRIOR ART
FIG. 4 is a diagrammatic view of another conventional lamp.
Figure 5:
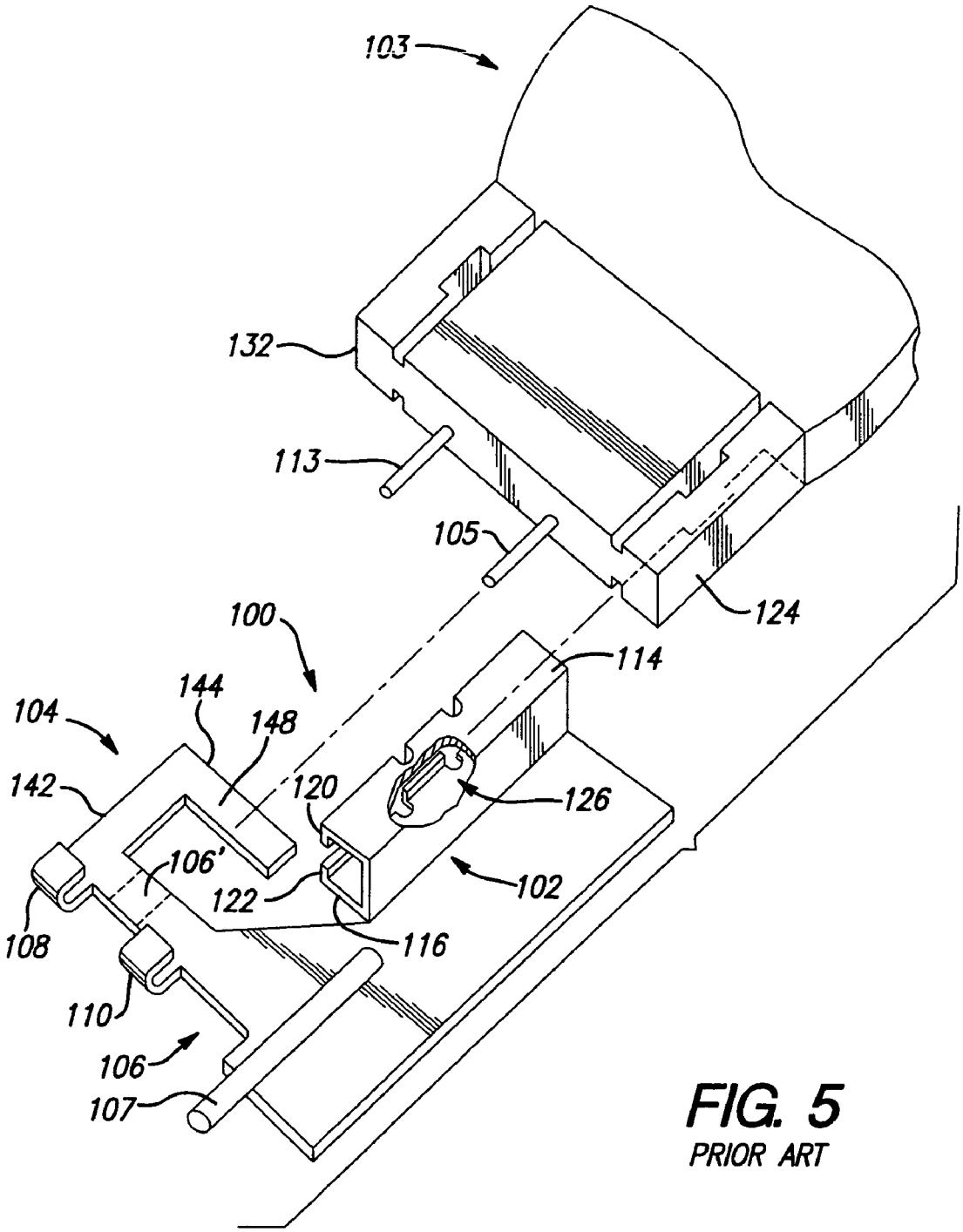
FIG. 5 PRIOR ART
FIG. 5 is an enlarged view of the support for the fuse and the lamp capsule of FIG. 4.
Figure 6A:
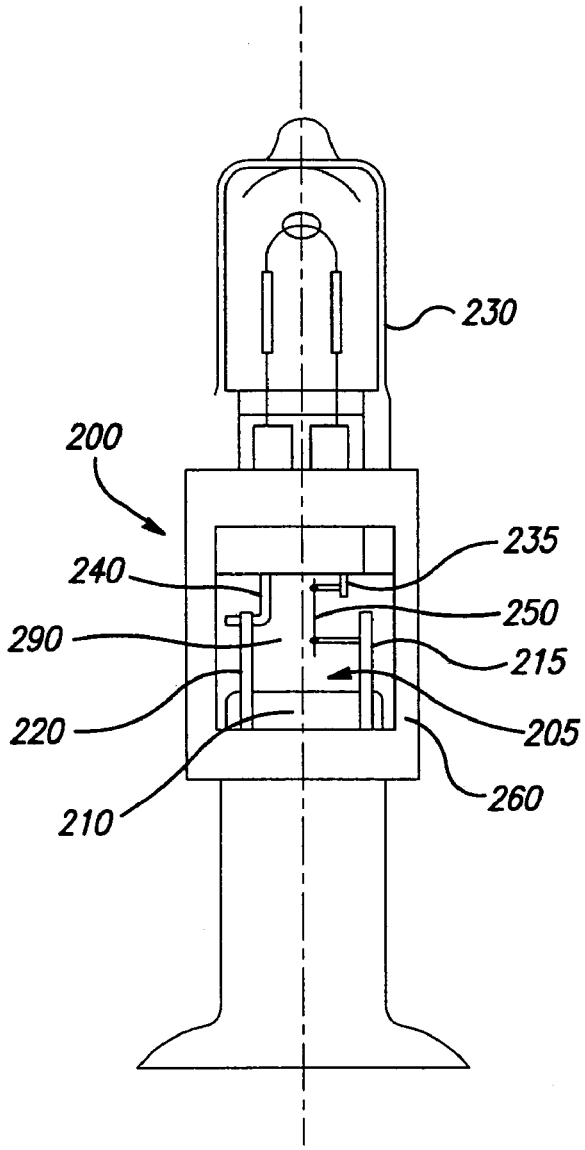
FIG. 6A is a diagrammatic view of an electric lamp assembly including a retainer of the present invention.
Figure 6B:
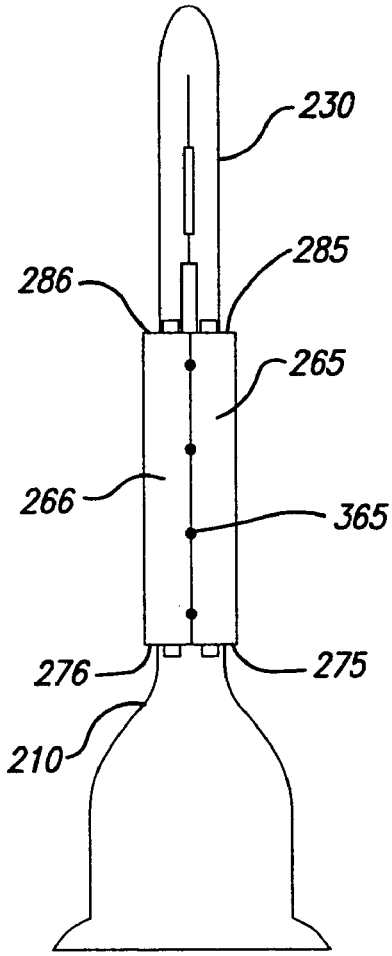
FIG. 6B is a diagrammatic view of the electric lamp assembly of FIG. 6A rotated 90° about longitudinal axis A using a first attachment device.

FIGS. 6A and 6B depict an electric lamp assembly 200 that includes a stem assembly 205. The stem assembly 205 includes a stem 210 and first and second electrical conductors 215, 220. The stem assembly 205 may be a conventional stem design for stems that are used in either incandescent or fluorescent lamp designs.

The lamp assembly 200 also includes conventional electric lamp capsule 230 that has first and second lead wires 235, 240. The first and second lead wires 235, 240 are electrically connected to the first and second electrical conductors 215, 220, respectively. A fuse 250 is electrically connected in series between first lead wire 235 and first electrical conductor 215 or between second lead wire 240 and second electrical conductor 220. The fuse 250 is preferably a coiled wire.

Figure 6C:
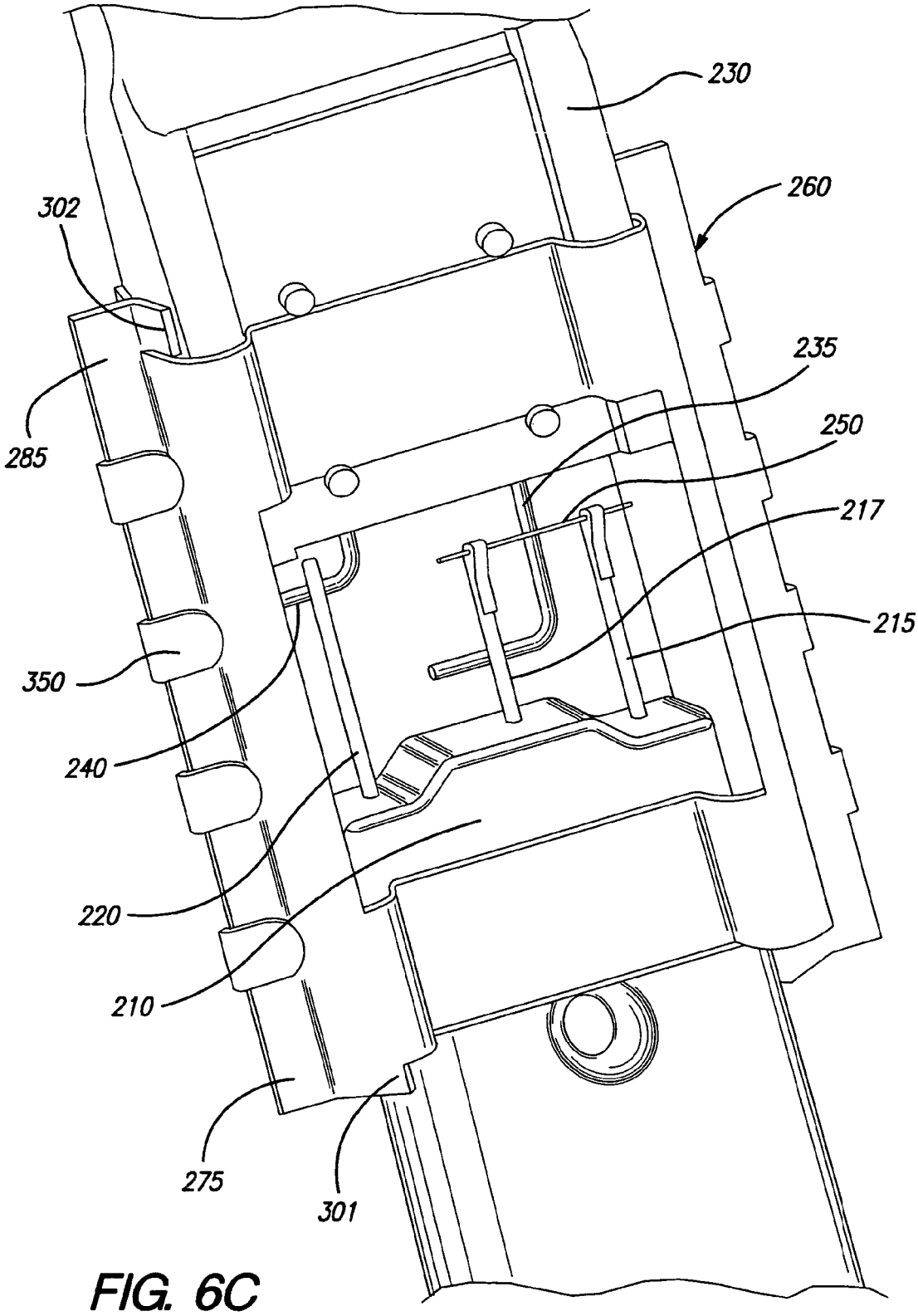
FIG. 6C is an enlarged oblique view of a retainer similar to that of FIG. 6A showing an alternate embodiment of a fuse connection and using a second attachment device.

Alternatively, as seen in FIG. 6C, the stem 210 may include a neutral third wire 217 between the first and second electrical conductors 215, 220. In this embodiment, the second lead wire 240 is connected to the second electrical conductor 220 and the fuse 250 is clamped to the first electrical conductor 215 and is clamped to the neutral third wire 217. In addition, the first wire 235 is also connected, preferably welded to the neutral third wire 217 to create a complete electrical circuit through the fuse 250.

A retainer 260 mechanically connects the stem assembly 205 at stem 210 to the lamp capsule 230. The retainer is an important part of the lamp assembly 200 to prevent movement of the stem 210 with respect to the lamp capsule 230 and maintain a constant distance between the stem 210 and the lamp capsule 230, which allows the tolerance requirements of the fuse length to be maintained. Specifically, when a coiled fuse is used, the pitch of the coil determines the repeatability and failure parameters of the fuse. To maintain the pitch, the length of the fuse from start of the coil to the end of the coil should be kept constant (±0.05 mm). An acceptable manufacturing tolerance can be maintained using the retainer of the present invention.

Figure 7A:
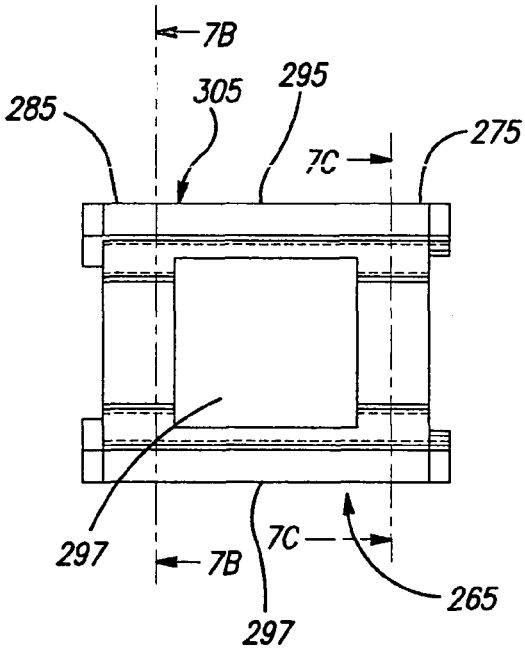
FIG. 7A is a plan view of a first frame of a first embodiment of the retainer of the present invention.
Figure 8A:
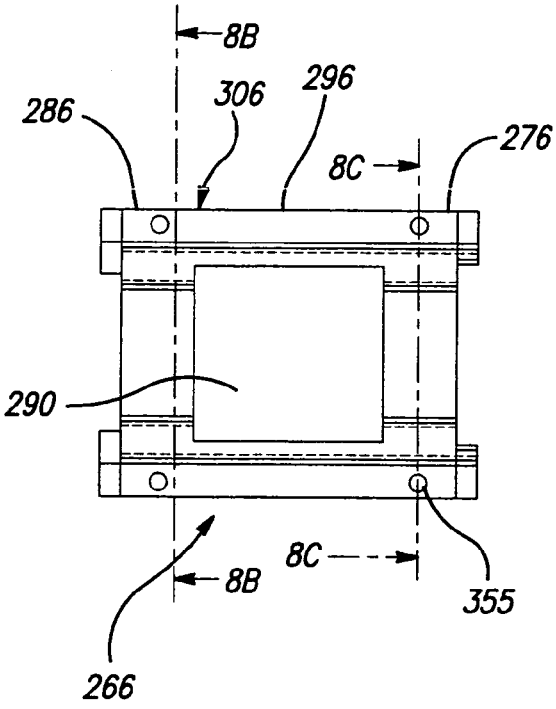
FIG. 8A is a plan view of a second frame of the first embodiment of the retainer of the present invention.
Figure 8B:
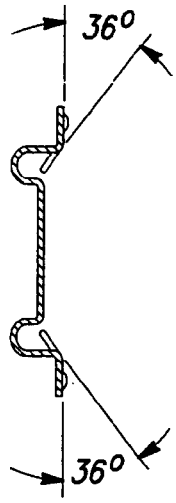
FIG. 8B is a side view of the first frame of FIG. 8A along the line B—B.
Figure 8C:
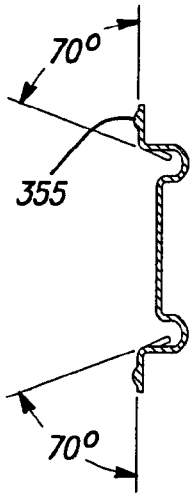
FIG. 8C is a side view of the first frame of FIG. 8A along the line C—C.
Figure 8D:
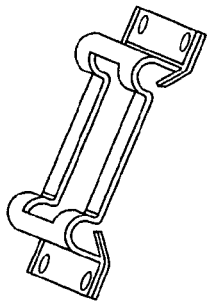
FIGS. 8D and 8E are oblique views of the first frame of FIG. 8A.

As best seen in FIGS. 6B, 7A and 8A, the retainer 260 has first and second plates 265, 266. The first plate has first and second opposing ends 275, 285 and the second plate has first and second opposing ends 276, 286. The stem 210 is clamped between the first ends 275, 276 of the first and second plates 265, 266 and the capsule 230 is clamped between the second ends 285, 286 of the first and second plates 265, 266. The first and second plates are shaped at the first and second ends to conform to the stem and the lamp.

As further seen in FIGS. 6A, 7A and 8A, the first and second plates 265, 266 each consist of a rigid frame 305, 306 defining an opening 290 in which the first and second electrical conductors 215, 220, the first and second lead wires 235, 240 and the fuse 250 are exposed. Based on the above design, the lamp assembly 200 can be manufactured off-site and readily inserted into a conventional lamp once the stem and capsule are connected to the retainer.

To make the connection easier, the first rigid frame 305 has first and second sides 295, 297 and the second rigid frame 306 also has first and second sides 296, 298. In a preferred embodiment as seen in FIGS. 7A and 8A, the first and second plates 265, 266 are generally rectangular having flat sides. Although a rectangular plate is preferred, oval or circular plates could be used as long as there is a straight or flat internal edge against which side surfaces of the stem and capsule can be placed.

Figure 7B:
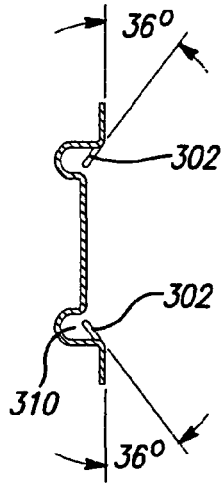
FIG. 7B is a side view of the first frame of FIG. 7A along the line B—B.
Figure 7C:
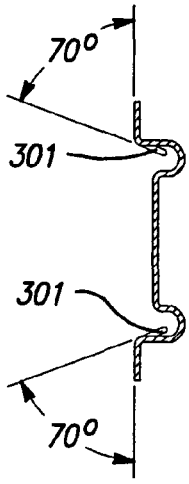
FIG. 7C is a side view of the first frame of FIG. 7A along the line C—C.

Also in the preferred embodiment, the first and second ends 275,276 and 285,286 have grooves 310 in which the stem 210 and the capsule 230 are clamped such that as seen in FIG. 7B the two frames are arched in cross section at the first and second ends. As shown in FIGS. 7A, 7B and 7C, the sides are substantially perpendicular to the grooves 310 of the frame and include movable flanges 301, 302 at each end 275, 285. The flanges 301, 302 are elastically movable from a first position within the grooves to a second position. As seen in FIG. 6C, when the flange 302 is in the second position, it abuts against the capsule 230 to be substantially parallel to the side of the capsule 230 and is substantially perpendicular to the sides of the frame, but does not necessarily need to be perpendicular so long as the flange exerts pressure on the capsule to help maintain the rigidity of the assembly 200. Since the stem 210 may be shaped differently from the capsule, the flange 301 elastically moves to conform to the shape of the stem but does not necessarily become substantially perpendicular to the side of the stem. In each instance, the flanges 301, 302 will move sufficiently to exert pressure on the capsule and the stem to help maintain the rigidity of the assembly 200.

In order to maintain the rigidity of the assembly 200 and to prevent movement of the stem 210 with respect to the capsule 230, the first and second plates 265, 266 are attached to each other at the first and second sides 295,296 and 297, 298. As seen in FIGS. 6C, 11A, 11B, 12A and 12B, one side (297 in FIG. 11A and 296 of FIG. 12A) of the first and second plates 305, 306 have a plurality of foldable tabs 350 that secure the first and second plates 305, 306 to each other when the plural tabs 350 are in a folded position. Four tabs 350 are shown, however the number could be greater or less than four.

Alternatively, the sides 295, 297 of the first plate 305 can be welded to the sides 296, 298 of the second plate 306, or vice versa. Four welds 355 are shown in FIG. 8A, however the number could be greater or less than four. Since the plates can be welded, the plates should be metal, preferably the first and second plates 265,266 are nickel-plated steel. Any additional manner of connecting the two opposing sides to each other is also contemplated as long as the capsule and the stem remain securely between the sides.

Figure 9A:
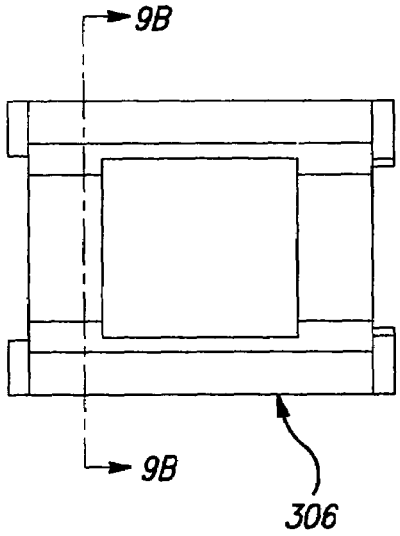
FIG. 9A is a plan view of a modified first frame of the first embodiment of the retainer of the present invention.
Figure 9B:
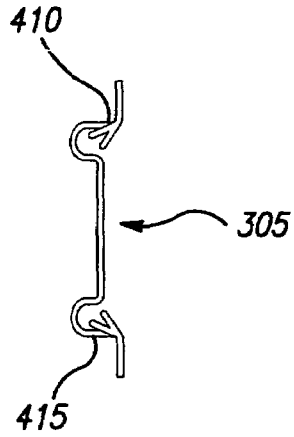
FIG. 9B is a side view of the first frame of FIG. 9A along the line B—B.
Figure 10A:
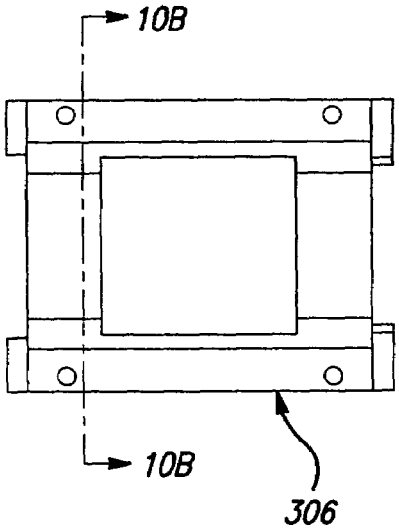
FIG. 10A is a plan view of a modified second frame of the first embodiment of the retainer of the present invention.
Figure 10B:
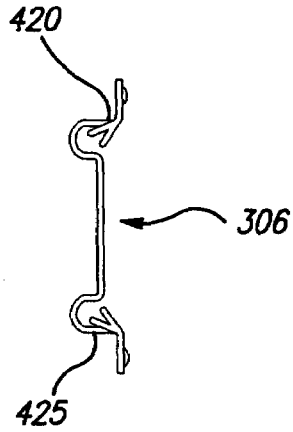
FIG. 10B is a side view of the first frame of FIG. 10A along the line B—B.
Figure 11A:
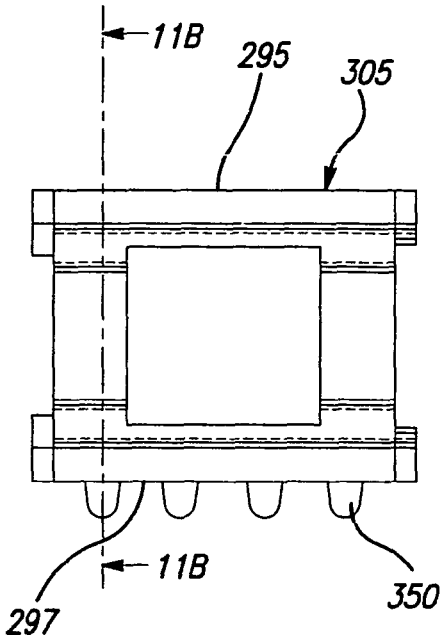
FIG. 11A is a plan view of a first frame of a second embodiment of the retainer of the present invention.
Figure 11B:
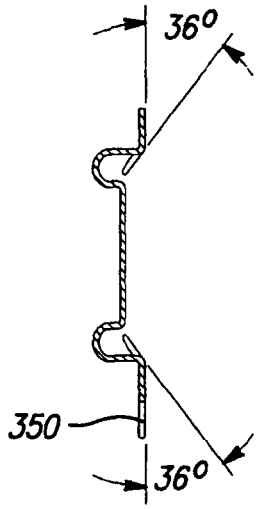
FIG. 11B is a side view of the first frame of FIG. 11A along the line B—B.
Figure 12A:
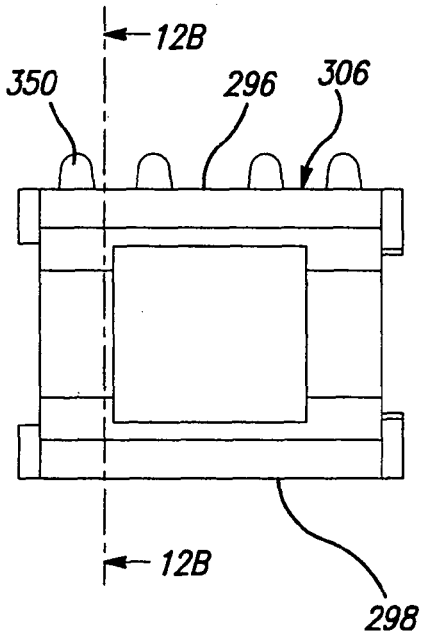
FIG. 12A is a plan view of a second frame of a modified second embodiment of the retainer of the present invention.
Figure 12B:
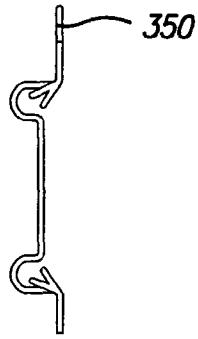
FIG. 12B is a side view of the first frame of FIG. 12A along the line B—B.

In another embodiment, since some conventional stems and capsules are manufactured with recesses, retainers that have elements that co-act with the recesses are contemplated. Accordingly, as seen in FIGS. 9B and 10B, the first and second plates 305, 306 can also include a pair of detents (one on each side 410, 415, 420 and 425) that snap into respective recesses in the stem and the capsule.

Since the stem assembly and the capsule may be known, conventional elements, the lamp assembly of the present invention is particularly useful in conventional existing lamp fixtures. Specifically, the lamp assembly of the present invention readily slides into a conventional lighting envelope. A conventional lighting envelope is seen in FIG. 13, for example.

An electric lamp 360 typically includes a light transmissive outer envelope 365 that is usually made from a vitreous material that is transparent to light. The envelope 365 is sealed to enclose an air-tight environment that preferably is filled with a gas that is inert with respect to the fuse 250, such as helium. Helium is preferable for the environment to lower the ambient temperature in the envelope and prevent losses in the fuse, although nitrogen will serve a similar purpose although not being as efficient.

Envelope 365 may be fabricated in a conventional manner. The envelope 365 is sealed in a conventional manner at stem 210. First and second electrical conductors 215 and 220 are sealed into and pass through the envelope 365 at the stem 210 in a conventional manner. The ends of the conductors 215 and 220 are electrically connectable external of the envelope 365 to a source 222 of electrical power.

Figure 13:
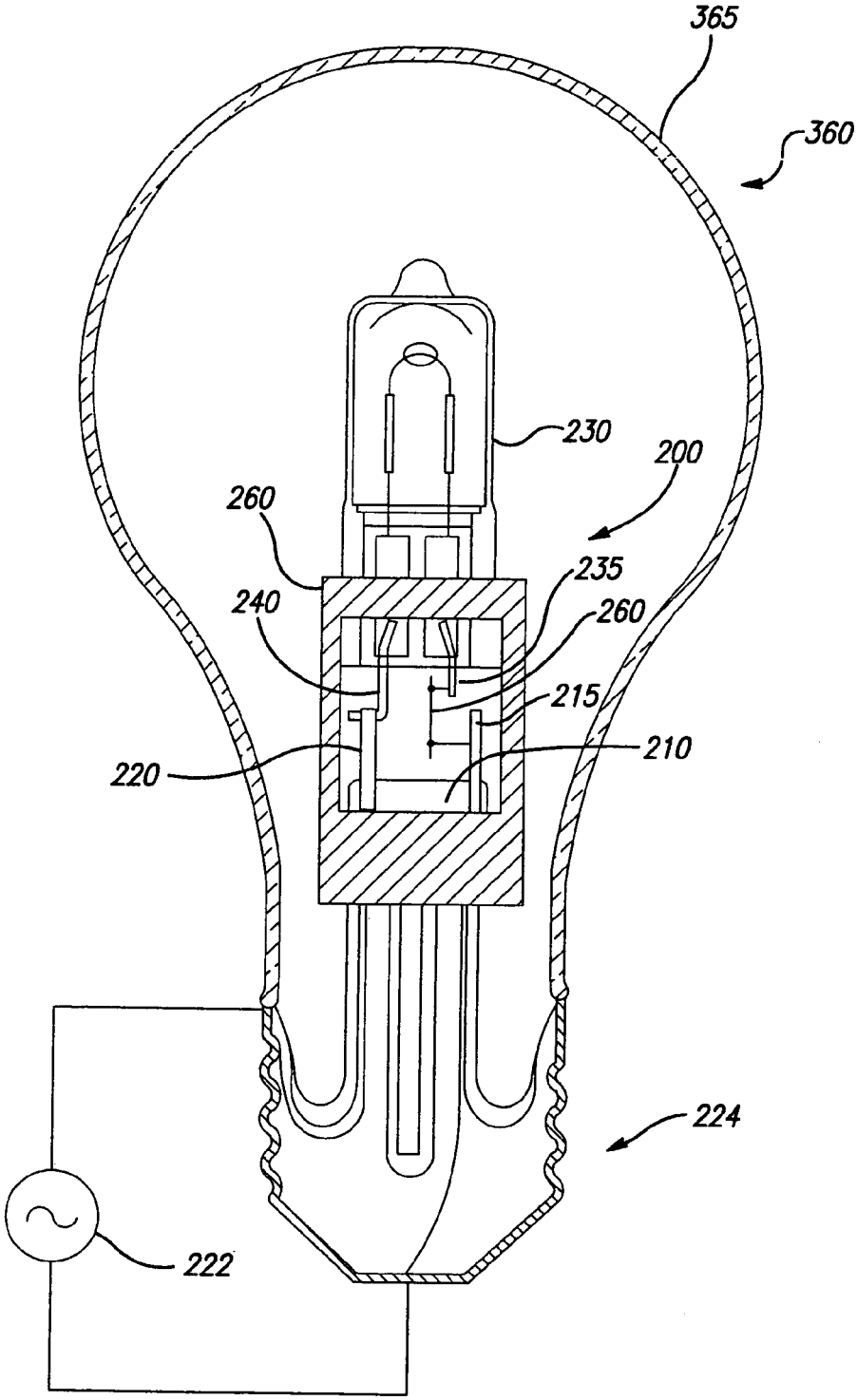
FIG. 13 is a diagrammatic view of an electric lamp assembly of the present invention in a conventional incandescent lamp.

To this end, in the embodiment illustrated in FIG. 13, a conventional screw-type lamp base 224 is provided. The lamp base 224 is mechanically connected to the envelope 365 in a conventional manner. The lamp base 224 is electrically connected to conductors 215 and 220. The lamp base 224 is threaded for insertion into a mating internally threaded lamp socket (not shown).

The stem 210 is part of lamp assembly 200 that also includes a single-ended electric lamp capsule 230 having first and second lead wires 235, 240. As set forth above, the first and second lead wires are electrically connected to the first and second electrical conductors, respectively. The fuse 250 is positioned external of the lamp capsule 230 and within the hermetically sealed thin wall outer envelope 365. In the embodiment illustrated in FIG. 13, the fuse 250 is of the type that will ignite in the presence of air to open the circuit that the fuse completes between the electrical conductor 215 and the lead wire 235.

The fuse 250 of the present invention may be chosen from various types. For example, a straight or coiled foil or wire filament may be used. As set forth above, the preferred fuse is a coiled wire fuse because this fuse is simple and cost effective. Any of a number of materials may be used. For example, metal or metal alloys that react with air at an elevated temperature, as described hereinafter, may be selected. Tungsten, tantalum, zirconium, halfnuim and aluminum are examples of metals which can be used. A preferred fuse may be in the form of a coiled tungsten wire represented in FIG. 13 as the fuse 250. The coiled tungsten wire provides a pyrophoric fuse. Whatever form of fuse is used, it must be capable of rapid ignition during lamp operation in the presence of air to thereby open the lamp circuit.

Figure 7D:
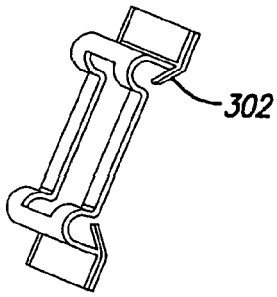
FIGS. 7D and 7E are oblique views of the first frame of FIG. 7A.
Figure 7E:
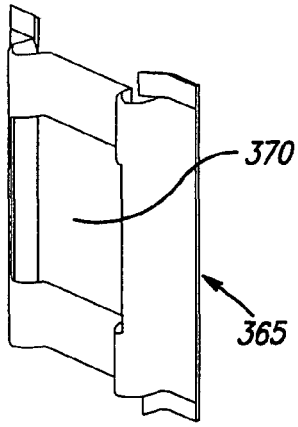
Figure 8E:
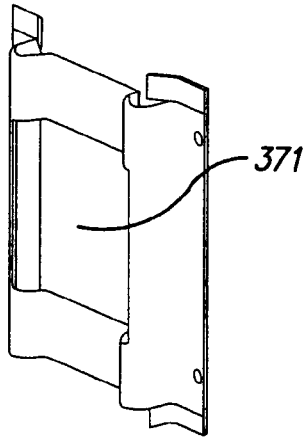

As a further safety precaution a shield 370, 371 can be connected to the retainer 260 for covering the opening 290 as seen in FIGS. 7E and 8E. Preferably, the shield is snapped into the opening and frictionally held within the opening to prevent accidental contact of the electrically conductors and lead wires with the current if the outer glass envelope 365 is broken.

One method of fabricating the electric lamp assembly of the present invention will now be described with reference to FIGS. 6A, 6B and 6C. A stem assembly 205 is formed having a stem 210 and first and second electrical conductors 215, 220. The stem assembly 205 is placed on a first retainer plate 265 such that a first face of the stem 210 is adjacent to one end 275 of the first retainer plate 265. A first face of a lamp capsule 230 is then placed adjacent to an opposite end 285 of the first retainer plate 265. The lamp capsule 230 may be a conventional lamp capsule 230 having a first lead wire 235 and a second lead wire 240. One example of such lamp capsule is a tungsten halogen capsule.

A second retainer plate 266 is then placed against a second face of the stem 210 and the lamp capsule 230 such that both the lamp capsule 230 and the stem 210 are between the first and second retainer plates 265, 266. The first and second retainer plates 265, 266 are then mechanically connected to each other either by welding the first and second retainer plates 265, 266 to each other as seen in FIG. 6B, or by folding foldable tabs extending from a first side of each retainer plate as seen in FIG. 6C around a second side of an opposing one of the first and second retainer plates 265, 266.

As seen in FIG. 6B, the first and second retainer plates are only welded at sides of the first and second retainer plates 265, 266. However, different mechanical connections at the ends are also contemplated. Next, the first and second lead wires 235, 240 of the capsule 230 are mechanically and electrically connected to the first and second electrical conductors 215, 220 of the stem assembly 205 such that the second lead wire 240 is connected to the second electrical conductor 220 and the fuse 250 is connected in series between the first lead wire 235 and the first conductor 215. Clamps may be attached at ends of the first lead wire and the first electrical conductor to grip the fuse 250 and hold it in place. As seen in FIG. 6A, the fuse 250 is connected in series between the first lead wire 235 and the first conductor 215. However, the fuse can be connected in series with either one of the first and second lead wires.

Alternatively, the stem may include a neutral third wire 217 between the first and second electrical conductors 215, 220 as seen in FIG. 6C. In this embodiment, the second lead wire 240 is still connected to the second electrical conductor 220 and the fuse 250 is clamped to the first electrical conductor 215. However, instead of the fuse being connected to the first wire, the fuse 250 is clamped to the neutral third wire 217 and the first wire is also connected, preferably welded to the neutral third wire 217 to create a complete electrical circuit through the fuse 250. To further secure the stem assembly to the capsule, an additional step of snapping a pair of detents of each of the first and second plates into a recess on a respective one of the stem assembly and the capsule can be performed.

Since the stem and lamp capsule used in manufacturing the lamp assembly of the present invention may be know in the art, the assembly can readily be inserted into a conventional fixture to be used as a fused fixture to prevent fire or damage if the outer envelope of the fixture is damaged as set forth above. Accordingly, the fuse is successfully integrated into conventional manufacturing processes to minimize liability.

The inventors of the present invention have found that a rigid, generally rectangular one-piece frame as seen in FIG. 7D, for example, is easiest to manufacture and offers the best solution to prevent movement of the capsule with respect to the stem. However, a multiple piece frame having top and bottom pieces welded to two side pieces is also contemplated. Preventing the stem from moving with respect to the capsule allows the length tolerance requirements of the fuse to be very tight so that a manufacturing tolerance of ±0.05 mm can be maintained. Therefore, the repeatability and failure parameters of the fuse can be maintained within acceptable tolerance.

Regardless of the specific construction of the retainer 260, the retainer 260 is structured and arranged to hold the stem assembly 205 and the lamp capsule 230 a fixed distance apart with respect to a longitudinal axis A of the capsule as seen in FIG. 6A. In addition, the retainer is structured and arranged to center the stem assembly and the capsule along the longitudinal axis A to prevent movement of the stem assembly and the capsule with respect to each other in a direction perpendicular to the longitudinal axis A.

As set forth above in the preferred embodiments, the plurality of welds 355 or the plurality of foldable tabs 350, connect the first and second frames to each other to maintain the rigidity of the retainer 260. However, different methods of connecting the first and second frames to each other would be readily apparent to those of ordinary skill in the art and the aforementioned examples are meant to be non-limiting.

Since the retainer 260 connecting the stem 210 and the lamp capsule 230 provides rigidity, manufacturing length tolerances are maintained to keep the accuracy of the failure parameters of the fuse. The construction of the retainer also prevents the electrical conductors from manual contact in the event of failure of the outer jacket.

The embodiments that have been described herein are but some of several which utilize this invention and are set forth here by way of illustration but not of limitation. It is apparent that many other embodiments that will be readily apparent to those skilled in the art may be made without departing materially from the spirit and scope of this invention.

The invention claimed is:

1. An electric lamp assembly, comprising:

a stem assembly comprising a stem and first and second electrical conductors;

an electric lamp capsule comprising first and second lead wires, said first and second lead wires being electrically connected to said first and second electrical conductors, respectively;

a fuse electrically connected in series with one of said first and second lead wires; and a retainer comprising first and second plates each having first and second ends, said stem being clamped between said first ends of said first and second plates and said capsule being clamped between said second ends of said first and second plates.

2. The electric lamp assembly of claim 1, wherein said first and second plates each comprise a rigid frame defining an opening in which said first and second electrical conductors, said first and second lead wires and said fuse are exposed.

3. The electric lamp assembly of claim 2, wherein each said rigid frame has first and second sides, said first and second plates being attached to each other at said first and second sides.

4. The electric lamp assembly of claim 3, wherein one of said first and second sides of both of said first and second plates have a plurality of foldable tabs that secure said first and second plates to each other when said plural tabs are in a folded position.

5. The electric lamp assembly of claim 3, wherein said sides of said first plate are welded to said sides of said second plate.

6. The electric lamp assembly of claim 2, further comprising a shield connectable to said retainer for covering said opening.

7. The electric lamp assembly of claim 1, wherein said first and second plates are rectangular and said first and second ends have grooves in which said stem and said capsule are clamped.

8. The electric lamp assembly of claim 1, wherein said first and second plates are nickel-plated steel.

9. The electric lamp assembly of claim 1, wherein each of said first and second plates further comprises a pair of detents that snap into respective recesses in said stem and said capsule.

10. An electric lamp comprising:

a light transmissive outer envelope with a lamp assembly therein, said lamp assembly comprising, a stem assembly comprising a stem and first and second electrical conductors;

a single-ended electric lamp capsule comprising first and second lead wires disposed at one end of said capsule, said first and second lead wires being electrically connected to said first and second electrical conductors, respectively;

a pyrophoric fuse electrically connected in series with one of said first and second lead wires;

a retainer mechanically connecting said stem assembly to said capsule, said retainer comprising first and second substantially identical rigid frames each having first and second ends and first and second sides, said stem being clamped between respective said first ends and said one end of said capsule being clamped between respective said second ends, said frames having an opening therethrough in which said lead wires, said conductors, and said fuse are exposed, each said first and second frames being a one-piece frame.

11. The electric lamp of claim 10, wherein said first and second sides have a plurality of welds to connect said first and second frames to each other.

12. The electric lamp of claim 10, wherein one of said first and second sides of both of said first and second frames further comprise a plurality of foldable tabs extending therefrom that secure said first and second pieces together when said plural tabs are in a folded position.

13. The electric lamp assembly of claim 10, wherein said rigid frames are generally rectangular and each further comprise a movable flange that is movable from a first position to a second position that is substantially perpendicular to said respective ones of said first and second sides.

14. The electric lamp of claim 10, wherein each of said first and second plates further comprises a pair of detents that snap into recesses in respective ones of said stem and said capsule.

15. The electric lamp of claim 10, wherein said retainer is electrically isolated from said leads, said conductors and said fuse.

16. The electric lamp assembly of claim 10, wherein said retainer is structured and arranged to hold said stem assembly and said capsule a fixed distance apart with respect to a longitudinal axis of said capsule.

17. The electric lamp assembly of claim 16, wherein said retainer is structured and arranged to center said stem assembly and said capsule along said longitudinal axis to prevent movement of said stem assembly and said capsule with respect to each other in a direction perpendicular to said longitudinal axis.

18. An electric lamp assembly, comprising:

a rigid chassis defined by two generally rectangular frames that are joined to each other along both sides of said chassis, said chassis having an opening therein;

a stem having two electrical conductors passing therethrough and into said opening, said stem being held between said two frames at one end of said chassis; and a lamp having two leads extending from one end thereof and into said opening, said one end of said lamp being held between said two frames at a second end of said chassis opposite said one end, one of said two leads being connected to one of said two conductors through a fuse.

19. The lamp assembly of claim 18, wherein said two frames are substantially identical.

20. The lamp assembly of claim 18, wherein said two frames are plates that are shaped at said first and second ends to conform to said stem and said lamp.

21. The lamp assembly of claim 20, wherein said two frames are arched in cross section at said first and second ends.

22. The electric lamp assembly of claim 21, wherein said two frames are flat at said sides of said chassis.

23. The electric lamp assembly of claim 18, wherein said stem further comprises a neutral third wire between said two electrical conductors, another one of said wires being connected to another one of said two electrical conductors, and wherein said fuse is clamped to said one electrical conductor and to said neutral third wire and said one wire is connected to the neutral third wire to create a complete electrical circuit through the fuse.

24. The electric lamp assembly of claim 23, wherein said fuse is coiled.

25. A method of manufacturing an electric lamp assembly comprising the steps of:

placing a first face of a stem assembly adjacent to one end of a first retainer plate;

placing a first face of a capsule adjacent to an opposite end of the first retainer plate;

placing a second retainer plate against a second face of the stem assembly and the capsule;

mechanically connecting said first and second retainer plates to each other;

electrically connecting first and second lead wires of said capsule to first and second electrical conductors of said stem assembly, respectively; and connecting a fuse in series with one of said first and second lead wires.

26. The method as claimed in claim 25, wherein said step of mechanically connecting said first and second retainer plates comprises welding said first and second retainer plates to each other.

27. The method as claimed in claim 26, wherein said first and second retainer plates are only welded at sides of said first and second retainer plates.

28. The method as claimed in claim 25, wherein said step of mechanically connecting said first and second retainer plates comprises folding foldable tabs extending from a first side of each plate around a second side of an opposing one of said first and second plates.

29. The method as claimed in claim 28, wherein said foldable tabs number four for each plate.

30. The method of claim 25, further comprising the step of snapping a pair of detents of each of the first and second plates into a recess on a respective one of the stem assembly and the capsule.

* * * * *